United States Patent [19]

Minamizono et al.

[11] 4,362,812

[45] Dec. 7, 1982

[54] PHOTOGRAPHIC MATERIALS

[75] Inventors: Junji Minamizono; Shinzo Kishimoto; Shigeki Yokoyama, all of Kanagawa; Takayuki Inayama, Shizuoka, all of Japan

[73] Assignee: Fuji Photo Film Co., Ltd., Kanagawa, Japan

[21] Appl. No.: 282,349

[22] Filed: Jul. 10, 1981

[30] Foreign Application Priority Data

Jul. 10, 1980 [JP] Japan ..... 55/94406

[51] Int. Cl.[3] ..... G03C 1/76

[52] U.S. Cl. ..... 430/528; 430/529; 430/536; 430/537; 430/627; 430/629; 430/630; 430/631; 430/961

[58] Field of Search ..... 430/528, 537, 627, 529, 430/631, 629, 630, 536, 537, 961

[56] References Cited

U.S. PATENT DOCUMENTS

| | | | |
|---|---|---|---|
| 3,709,690 | 1/1973 | Cohen et al. | 430/627 |
| 3,840,371 | 10/1974 | Usami et al. | 430/631 |
| 4,229,524 | 10/1980 | Yonegama et al. | 430/537 |
| 4,304,852 | 12/1981 | Sugimoto et al. | 430/528 |
| 4,330,618 | 5/1982 | Minamizono et al. | 430/528 |

*Primary Examiner*—J. Travis Brown

*Attorney, Agent, or Firm*—Sughrue, Mion, Zinn, Macpeak and Seas

[57] ABSTRACT

Static property in a photographic material is effectively prevented by incorporating a specific copolymer formed from, as the copolymerizable components, a betaine-containing polymerizable monomer and a fluorine-containing polymerizable monomer, in the protective layer, backing layer, or an overcoat of the photographic material without exhibiting adverse influences on the photographic properties of the photographic material.

15 Claims, No Drawings

PHOTOGRAPHIC MATERIALS

BACKGROUND OF THE INVENTION

This invention relates to photographic materials having an improved antistatic property, and more particularly, it relates to silver halide photographic materials having an improved antistatic property and resistance to adhesion without exhibiting adverse influences on the photographic properties.

Since a photographic material is generally composed of a support having an electric insulating property and photographic layers, electrostatic charges are frequently accumulated by contact friction between or separation from the surfaces of the same or dissimilar materials during the production or use of the photographic material. The electrostatic charges thus accumulated cause various problems, but the most serious trouble is that accumulated static charge may discharge before development of the photographic material to cause lightening-like exposure of photosensitive emulsion layers, whereby in the development of the photographic film, spot-like, twig-like, or feather-like marks form. These marks are so-called static marks, and occurrence of the static marks greatly reduces the commercial value of the photographic film, or in some cases may result in complete loss of commercial value. For example, it will be easily understood that if such a static mark appears in medical or industrial X-ray films, etc., it may induce a very dangerous misdiagnosis. This phenomenon is a very troublesome problem since the occurrence of the phenomenon is first found only at the time of developing the photographic film. The static charges accumulated also cause secondary problems, such as dust attaching to the surface of the photographic film and preventing coating of coating compositions from being uniformly performed.

Static charges frequently accumulate during the production and use of photographic materials as noted above. For example, such charges may be produced by contact friction of a photographic film against rollers during the production of the photographic film, or by separation of the surface of the emulsion layer from the surface of the support during winding or rewinding of the photographic film. Static charges are also produced in a finished photographic film by separation of the emulsion layer surface from the base surface in the case of performing winding or rewinding of a photographic film or in X-ray films by contact, separation, etc., between the X-ray films and mechanical parts or fluorescent intensifying screens in an automatic camera for X-ray films. The occurrence of static marks of photographic materials induced by the accumulation of such static charges becomes more severe as the sensitivity of photographic materials increases and as the processing speed for photographic materials increases. In particular, since the sensitivity of photographic materials has become higher, and there is an increased likelihood that the photographic materials will be treated under severe conditions, such as high-speed coating, high-speed photographing, high-speed automatic processing, etc., static marks have become increasingly likely to form.

Also, if a static charge is accumulated on the surface of a subbing layer in the case of forming the subbing layer on a film support and coating thereon a hydrophilic colloid layer such as a photosensitive silver halide emulsion layer, uneven distribution of the static charge appears and results in uneven coating of the hydrophilic colloid layer, which is a serious defect.

In one of the methods of overcoming the problems caused by these static charges, the electric conductivity of the surface of a photographic material is increased to dissipate the static charge in a short period of time before the accumulated charge discharges in a film-damaging manner.

Therefore, various methods have hitherto been considered to improve the conductivity of the supports and various surface coating layers of photographic materials, and it has been attempted to utilize various hygroscopic materials and water-soluble inorganic salts as well as certain kinds of surface active agents, polymers, etc. For example, there are the polymers as described in U.S. Pat. Nos. 2,882,157, 2,972,535, 3,062,785, 3,262,807, 3,514,291, 3,615,531, 3,753,716, 3,938,999, etc.; surface active agents as described in U.S. Pat. Nos. 2,982,651, 3,428,456, 3,457,076, 3,454,625, 3,552,972, 3,655,387, etc.; and zinc oxide, semiconductors, colloid silica, etc., as described in U.S. Pat. Nos. 3,062,700, 3,245,833, 3,525,621, etc.

However, these many materials as noted above show specificities depending upon the kinds of film supports and photographic compositions. That is, they may give good results for a specific film support and specific photographic emulsions as well as specific photographic elements, but they are not only useless for the static prevention of other different film supports and photographic elements, but also exhibit adverse influences on the photographic properties thereof.

Particularly, static prevention for hydrophilic colloid layers is very difficult, and it frequently happens that the reduction in surface resistance is insufficient in low humidity conditions, and adhesion troubles occur in a photographic material itself or between a photographic material and other dissimilar matters at high temperature and high humidity conditions.

On the other hand, some materials have very excellent antistatic effects, but cannot be used for photographic materials since they exhibit adverse influences on the photographic properties of silver halide photographic emulsions, such as sensitivity, fog, granularity, sharpness, etc., or they form scum in a fix solution. For example, it is generally known that polyethylene oxide series compounds have a static prevention effect, but they frequently exhibit adverse influences on the photographic properties of silver halide emulsions, such as increasing fog, desensitization, reduction in granularity, etc.

In another method of overcoming the problems of photographic materials caused by static charges, the static potential of the photographic materials is controlled to reduce the generation of static electricity by friction and separation.

For such purpose, it has hitherto been attempted to use the fluorine-containing surface active agents described, for example, in British Pat. Nos. 1,330,356 and 1,524,631, U.S. Pat. Nos. 3,666,478 and 3,589,906, Japanese Patent Publication No. 26687/77 and Japanese Patent Application (OPI) Nos. 46733/74 and 32322/76 (the term "OPI" as used herein refers to a "published unexamined Japanese patent application"), but it sometimes happens that the static preventing ability of the surface active agents decreases with the passage of time since they transfer or diffuse during the preservation of the photographic materials. Furthermore, when these fluorine-containing surface active agents are used with above-mentioned conductive materials, they sometimes reduce greatly the conductivity of the conductive materials.

Also for controlling the static potential of photographic materials, it has been attempted to overcome the aforesaid faults of the surface active agents by using fluorine-containing polymers as described, for example, in British Pat. No. 1,497,256, Japanese Patent Application (OPI) Nos. 15822/79 and 129520/77, Japanese Patent Publication No. 23828/74, British Patent Application No. 2,024,440 A, etc. However, when, for example, a copolymer of a polyethylene oxide-containing monomer and a fluorine-containing acrylic acid ester monomer is applied to photographic materials, it is attended by an increase in fog, desensitization, and reduction in granularity by the polyethylene oxide group, as described above. Also, when a copolymer of a quaternary nitrogen-containing monomer and a fluorine-containing acrylic acid ester is applied to photographic materials, it may be effective in the points of static prevention ability and the prevention of adhesion problems, but it exhibits serious adverse influences on the photographic properties of silver halide photographic emulsions, such as sensitivity, fog, etc. Thus, it is not very satisfactory to use these compounds for photographic materials.

SUMMARY OF THE INVENTION

A first object of this invention is to provide photographic materials having an improved antistatic property.

A second object of this invention is to prevent the occurrence of static charges on photographic materials without exhibiting adverse influences on the photographic properties (sensitivity, fog, granularity, sharpness, etc.).

A third object of this invention is to provide photographic materials having an improved antistatic property without causing adhesion problems.

A fourth object of this invention is to provide photographic materials having improved antistatic property without forming scum in a fix solution.

A fifth object of this invention is to provide photographic materials which show less reduction in antistatic properties with the passage of time.

These objects of this invention have been attained by incorporating a copolymer including, as copolymerizable components, a betaine-containing polymerizable monomer (i.e., containing a betaine group) represented by formula (I) or (II) and a fluorine atom-containing polymerizable monomer represented by formula (III) in at least one layer of a photographic material:

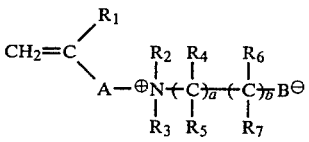

(I)

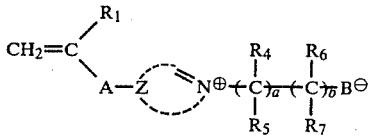

(II)

-continued

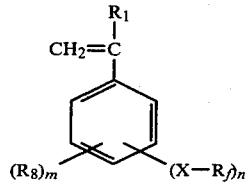

(III)

wherein $R_1$ represents hydrogen, a halogen atom, an alkyl group, or a substituted alkyl group; $R_2$, $R_3$, $R_4$, $R_5$, $R_6$, and $R_7$ each represents hydrogen, an alkyl group, or a substituted alkyl group; $R_8$ represents a monovalent substituent or when $m>1$ said $R_8$s may combine with each other to form a ring; A and X each represents a divalent group; Z represents an atomic group forming a heterocyclic ring; a and b each represents 0 or a positive integer, except that a and b are not simultaneously 0; m represents 0 or an integer of 1 to 4; n represents an integer of 1 to 5; B represents —COO or —$SO_3$; and $R_f$ represents an alkyl group, an aralkyl group, a substituted aralkyl group, an aryl group, or a substituted aryl group, wherein at least one hydrogen has been substituted by a fluorine atom.

DETAILED DESCRIPTION OF THE INVENTION

In preferred embodiments, $R_1$ represents hydrogen, a halogen atom, or an alkyl group having from 1 to 4 carbon atoms, and more preferably 1 or 2 carbon atoms, and said alkyl group may have a substituent (preferably, a hydroxy group, a halogen atom, etc.);

$R_2$, $R_3$, $R_4$, $R_5$, $R_6$, and $R_7$ each represents hydrogen or an alkyl group having from 1 to 6 carbon atoms, more preferably from 1 to 4 carbon atoms, said alkyl group may have a substituent (preferably, a hydroxy group, a halogen atom, etc.); at least one of $R_6$ and $R_7$ being, however, a group different from $R_4$ and $R_5$ when $b \neq 0$;

$R_8$ represents a monovalent substituent such as, preferably, a hydroxy group, a nitro group, a halogen atom, an alkyl group having from 1 to 6 carbon atoms, more preferably from 1 to 4 carbon atoms, said alkyl group may have a substituent (preferably, a halogen atom, a hydroxy group, etc.), —O—$R_9$ (wherein $R_9$ represents an alkyl group having from 1 to 6 carbon atoms, more preferably from 1 to 4 carbon atoms, or a substituted alkyl group) or

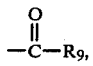

or when $m>1$ said $R_8$s may combine with each other to form a ring;

A represents a chemical bond or a divalent bonding group, such as an alkylene group having from 1 to 8 carbon atoms, said alkylene group may have a substituent (preferably, a halogen atom, a hydroxy group, etc.), an aralkylene group having from 6 to 11 carbon atoms, said aralkylene group may have a substituent (preferably, a hydroxy group, a nitro group, a lower alkyl group, a halogen, atom, etc.), —COO—$R_{10}$— (wherein $R_{10}$ represents a chemical bond or a divalent group such as an alkylene group having from 1 to 8 carbon atoms, and preferably from 1 to 6 carbon atoms, an aralkylene group having from 6 to 11 carbon atoms, an arylene group, etc.), —O—CO—$R_{10}$—, or $$-CO-\overset{R_{11}}{\overset{|}{N}}-R_{10}-$$

(wherein $R_{11}$ represents hydrogen an alkyl group having from 1 to 8 carbon atoms, more preferably from 1 to 6 carbon atoms, said alkyl group may have a substituent (preferably, a hydroxy group, a halogen atom, etc.), or an atomic group necessary for forming together with $R_2$, $R_3$ or $R_6$ a heterocyclic ring such as a piperazine ring;

X represents a chemical bond or a divalent bond, such as $-(R_{12})_x-Y-(R_{13})_y-W-$ (wherein Y and W represent a chemical bond or a divalent bond, such as, for example, —O—, —COO—, —OCO—, $$-\overset{R_{11}}{\overset{|}{C}}ON-,\ -\overset{R_{11}}{\overset{|}{N}}CO-,$$

—S—, —SCO—, $$-SO_2\overset{R_{11}}{\overset{|}{N}}-,\ -\overset{O}{\overset{\|}{C}}-,\ \text{or}\ -\overset{R_{11}}{\overset{|}{N}}-;$$

$R_{12}$ and $R_{13}$ represent a chemical bond or a divalent bond, such as an alkylene group having from 1 to 8 carbon atoms, more preferably from 1 to 6 carbon atoms, an aralkylene group having from 6 to 11 carbon atoms, or an arylene group; and x and y are 0 or 1); said X being, preferably —$R_{12}$—O—$R_{13}$—, $$-R_{12}-\overset{R_{11}}{\overset{|}{N}}-CO-R_{13}-,$$

—$R_{12}$—COO—$R_{13}$—, —$R_{12}$—OCO—$R_{13}$—, $$-R_{12}-SO_2-\overset{R_{11}}{\overset{|}{N}}-R_{13}-,\ -R_{12}-\overset{R_{11}}{\overset{|}{N}}-R_{13}-,$$

$$\text{or}\ -COO-R_{13}-\overset{R_{11}}{\overset{|}{N}}-SO_2-;$$

Z represents an atomic group forming a heterocyclic ring which is preferably a 5-membered or 6-membered ring including a quaternary nitrogen atom, and said ring may contain an oxygen atom or a nitrogen atom (non-quaternary), and said ring may have a substituent such as an alkyl group, a substituted alkyl group, a nitro group, a hydroxy group, etc.; examples of the heterocyclic ring being a pyridine ring, an imidazole ring, a benzimidazole ring, etc.;

a and b represent 0 or a positive integer (preferably 1 to 6, and more preferably 1 to 4), except that both a and b are not simultaneously 0;

m represents 0 or an integer of 1 to 4;

n represents an integer of 1 to 5;

B represents —COO or —$SO_3$; and $R_f$ represents an alkyl group having from 1 to 24 carbon atoms, more preferably from 1 to 18 carbon atoms, and most preferably from 1 to 12 carbon atoms, an aralkyl group, or an aryl group, said groups may have a substituent (e.g., a hydroxy group, a halogen atom other than fluorine, and, as a substituent for the benzene ring, a nitro group, an amino group, —O—$R_9$, $$-O-\overset{O}{\overset{\|}{C}}-R_9,$$

etc.), said $R_f$s may combine with each other or with $R_8$ to form a ring (such as a benzene ring, a heterocyclic ring, etc.), wherein at least one hydrogen has been substituted by a fluorine atom.

Typical examples of the betaine monomers of formula (I) or (II) particularly preferably used in this invention are illustrated below, although the betaine monomers used in this invention are not limited thereto.

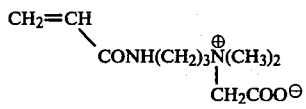
(I-1)

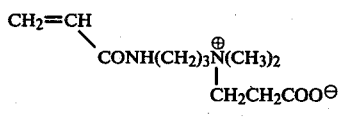
(I-2)

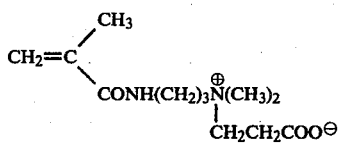
(I-3)

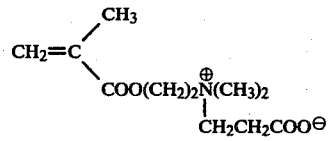
(I-4)

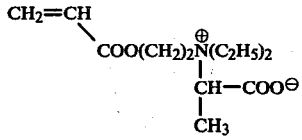
(I-5)

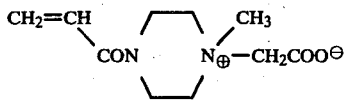
(I-6)

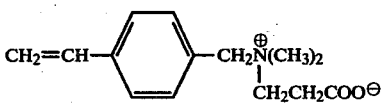
(I-7)

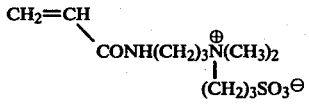
(I-8)

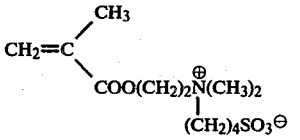
(I-9)

-continued (II-1)

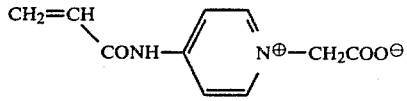

(II-2)

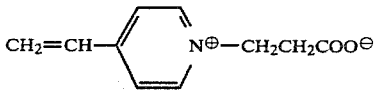

(II-3)

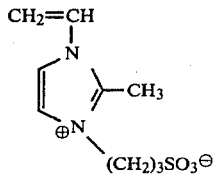

(II-4)

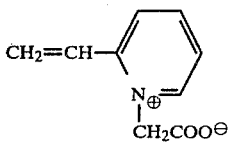

Typical examples of the fluorine-containing monomers of formula (III) particularly preferably used in this invention are illustrated below, although the invention is not limited thereto:

(III-1)

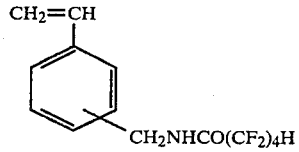

(III-2)

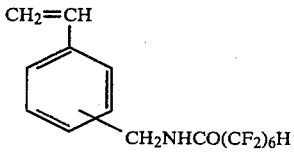

(III-3)

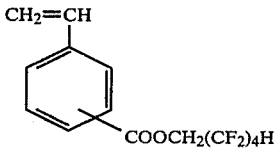

(III-4)

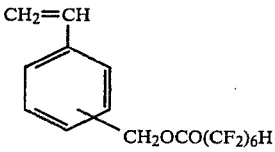

(III-5)

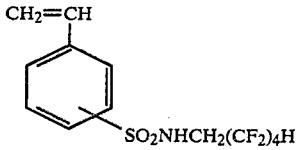

-continued (III-6)

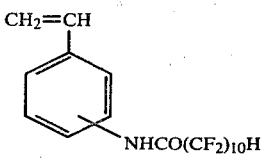

(III-7)

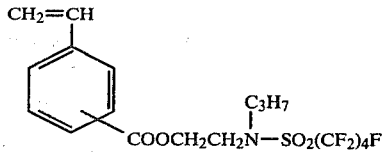

(III-8)

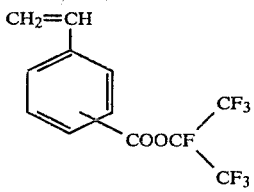

Also, the copolymer used in this invention may further contain other copolymerizing component but from the viewpoints of solubility and the objects of this invention, it is preferred that the mol% of the total content of the betaine monomer and the fluorine-containing monomer are above 50%, and it is more preferred that the content of the betaine monomer is from 95 to 50 mol%, the content of the fluorine-containing monomer is from 50 to 5 mol%, and the content of other monomer components, be from 45 to 0 mol%.

Examples of comonomers which may be used together with the above-described monomers used in this invention are acrylic acid, methacrylic acid, the alkyl esters of these acids (e.g., methyl methacrylate, ethyl acrylate, hydroxyethyl acrylate, propyl acrylate, cyclohexyl acrylate, 2-ethylhexyl acrylate, decyl acrylate, $\beta$-cyanoethyl acrylate, $\beta$-chloroethyl acrylate, 2-ethoxyethyl acrylate, sulfopropyl methacrylate, etc.), vinyl esters (e.g., vinyl acetate, vinyl propionate, vinyl butyrate, etc.), vinyl ethers (e.g., methyl vinyl ether, butyl vinyl ether, oleyl vinyl ether, etc.), vinyl ketones (e.g., methyl vinyl ketone, ethyl vinyl ketone, etc.), styrenes (e.g., styrene, methylstyrene, dimethylstyrene, 2,4,6-trimethylstyrene, ethylstyrene, laurylstyrene, chlorostyrene, methoxystyrene, cyanostyrene, chloromethylstyrene, vinylbenzoic acid, styrenesulfonic acid, $\alpha$-methylstyrene, etc.), vinylheterocyclic compounds (e.g., vinylpyridine, vinylpyrrolidone, vinylimidazole, etc.), acrylonitrile, vinyl chloride, vinylidene chloride, ethylene, propylene, butadiene, diisobutylene, isoprene, chloroprene, etc.

The invention is not limited to the above-described additional copolymerizable monomers, and any copolymers having structural units derived from monomers of formulae (I) or (II) and (III) may be used in this invention.

Practical examples of the typical copolymers used in this invention are illustrated below, wherein the copolymerization ratios x, y, and z (representing mol% content values) shown in the following examples are particular examples, and the copolymers used in this invention are not limited to these ratios.

(P-1)
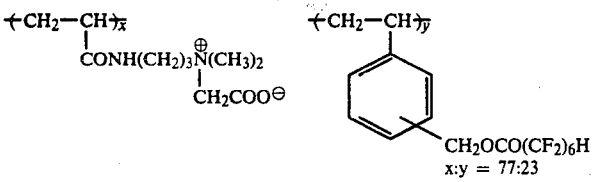
(P-2)
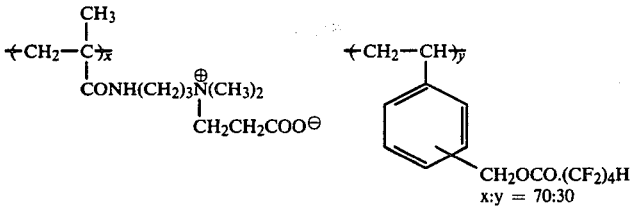
(P-3)
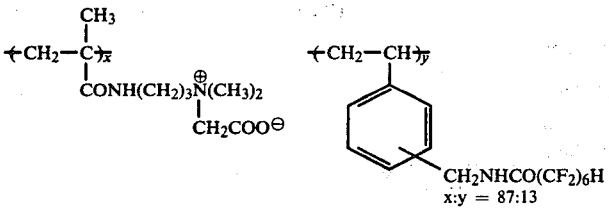
(P-4)
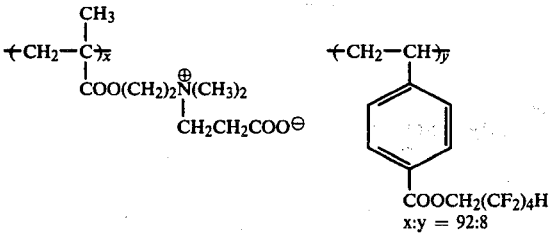
(P-5)
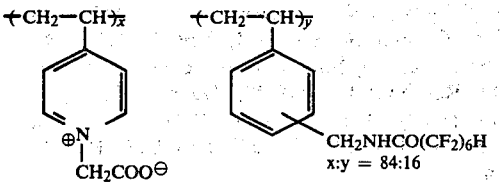
(P-6)
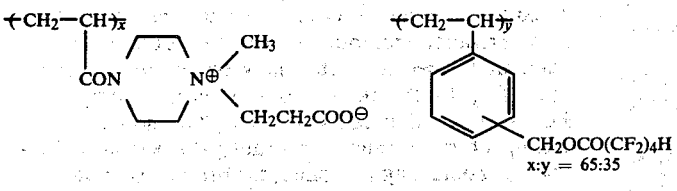
(P-7)
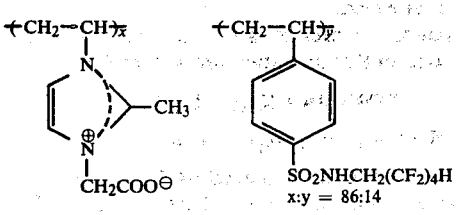
(P-8)
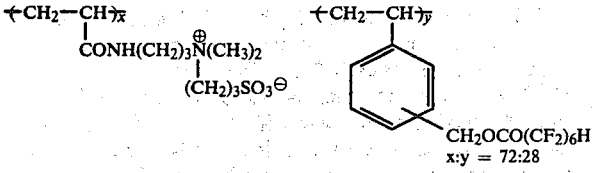

-continued (P-9)

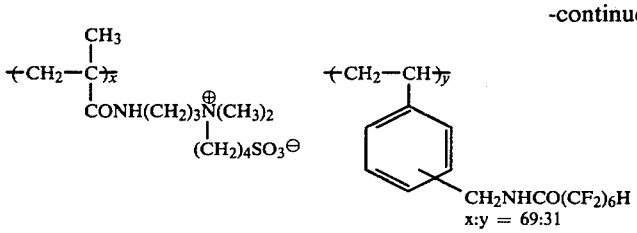

(P-10)

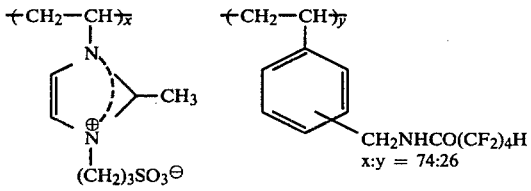

(P-11)

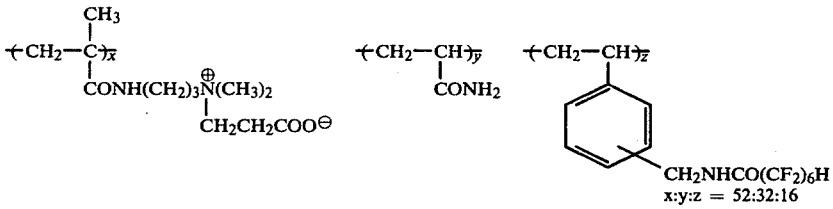

(P-12)

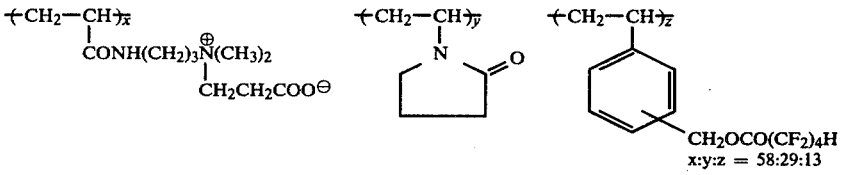

Methods for preparing the betaine monomers used in this invention are described, for example, in U.S. Pat. Nos. 2,777,872, 2,846,417, 3,411,912, 3,832,185 and 4,012,437, and Japanese Patent Publication Nos. 3832/70, 19951/70, 30293/71 and 1040/74 and *Polymer*, Vol. 18, 1058 (1977). Typical methods for producing the betaine monomer include a method wherein an $\alpha$-halogenated organic acid such as monochloric acid is added to a tertiary amino group-having monomer such as N,N-dimethylaminopropyl acrylate, and a method wherein a lactone such as $\beta$-propiolactone is ring-opened and added to a tertiary amino group-having monomer.

Methods for producing the fluorine-containing monomers used in this invention are described, for example, in U.S. Pat. Nos. 2,436,144, 2,592,069, 2,628,958, 2,642,416, 2,803,615, 3,102,103, 3,491,169 and 3,714,245, Japanese Patent Publication Nos. 12883/67, 9205/68, 20466/68, 851/69, 1994/69, 26286/69, 29724/71, 42371/71, 43894/71 and 20609/72, Japanese Patent Application (OPI) Nos. 52019/75, 121184/75, 134040/75 and 134046/75, *Journal of Polymer Science*, Vol. 15, 515 (1955), and ibid., Vol. 15, 520 (1955).

Typical methods for producing the fluorine-containing monomers used in this invention include a method wherein aminostyrene or aminomethylstyrene is reacted with $R_fCOCl$, a method wherein hydroxymethylstyrene is reacted with $R_fCOCl$, and a method wherein vinylbenzoic acid chloride is reacted with $R_fCH_2NH_2$ (wherein $R_f$ has the same meaning as described above).

These raw materials for preparing the aforesaid monomers may be prepared by referring to, for example, *Kobunshi Ronbun Shu* (Polymer Reports), Vol. 32, 308 (1975), *Journal of the Chemical Society*, 1515 (1962), *Journal of Applied Polymer Science*, Vol. 5, 452 (1961), *Journal of Polymer Science*, A-1, Vol. 7, 725 (1969), Lovelace et al., *Aliphatic Fluorine Compounds*, published by Reinhold Co. (1958), *Journal of American Chemical Society*, Vol. 78, 4999 (1956), ibid., 5621 (1953), British Pat. No. 717,232 and U.S. Pat. No. 2,559,630.

The copolymers used in this invention may be prepared by a solution polymerization method, an emulsion polymerization method, etc., and the reaction solvent, reaction temperature, etc., may be properly selected according to the polymerization method employed. Furthermore, after copolymerizing the monomer containing a tertiary amine for forming the betaine and the fluorine-containing monomer, the betaine-forming reaction may be performed.

Typical examples of preparing the monomers and the copolymers used in this invention are shown below.

SYNTHESIS EXAMPLE 1

Synthesis of Compound (I-1)

In a reaction vessel were placed 94.5 g (1 mol) of monochloroacetic acid and 350 ml of methanol, and the mixture was stirred at 0° to 5° C. To the mixture was added dropwise slowly 193 g of a 28% methanol solution of sodium methylate so that the temperature of the system was not over 30° C. Thereafter, a mixture of 156.2 g (1 mol) of 3-acrylamidopropyldimethylamine and 300 ml of methanol was added to the mixture. (Furthermore, 0.5 g of phenothiazine was added as a polymerization inhibitor.) Then, after heating the system to 60° C., the mixture was further stirred for 10 hours.

Thereafter, sodium chloride formed was removed by filtration, and the remaining reaction mixture was crystallized in a large amount of acetone. The identification of the compound formed was performed by the nuclear magnetic resonance (NMR) spectral analysis, elementary analysis, infrared spectral analysis, etc. The amount of the product was 145 g (yield of 68%).

SYNTHESIS EXAMPLE 2

Synthesis of Compound (I-3)

In a reaction vessel were placed 72.06 g (1 mol) of β-propiolactone and 250 ml of acetonitrile and after cooling the system to −20° C., the mixture was stirred at the temperature. To the mixture was added dropwise a mixture of 170 g (1 mol) of 3-methacrylamidopropyldimethylamine and 700 ml of acetonitrile while controlling the temperature of the system not exceeding −10° C. The reaction mixture was allowed to stand overnight at 0°-5° C., whereby white hygroscopic crystals formed. By recovering the crystals of filtration, 202 g of the desired compound was obtained with a yield of 84%. The structure of the compound was confirmed by NMR spectral analysis, elementary analysis, and infrared spectral analysis. The melting point thereof was 109°-111° C.

SYNTHESIS EXAMPLE 3

Synthesis of Compound (II-3)

In a reaction vessel were placed 70 g (0.58 mol) of 1,3-propanesultone and 800 ml of ethyl acetate and after cooling the mixture to 10° C., the mixture was stirred at the temperature. To the mixture was added dropwise 50 g (0.46 mol) of 1-vinyl-2-methylimidazole and the mixture was stirred for 1 hour at 10°-15° C. Then, the temperature of the system was gradually increased to 50° C. and the mixture was stirred for 5 days. Crystals formed were recovered by filtration and dried to provide 104 g of the desired compound with a yield of 87%.

The structure of the compound was confirmed by NMR spectral analysis, elementary analysis, and infrared spectral analysis.

SYNTHESIS EXAMPLE 4

Synthesis of Compound (III-2)

In a reaction vessel were placed 300 ml of acetonitrile, 33.9 g (0.3 mol) of vinylbenzylamine (mixture of meta/para isomers at about 6/4), 30.3 g (0.3 mol) of triethylamine, and 0.5 g of 2,6-di-t-butylphenol and the mixture was stirred under ice-cooling. To the mixture was added dropwise 109.5 g (0.3 mol) of 2,2,3,3,4,4,5,5,6,6,7,7-dodecafluoro-n-heptanoic acid chloride (b.p. of 131°-133° C.). Thereafter, the mixture was stirred for 1 hour at room temperature and triethylamine hydrochloride thus formed was removed by filtration. Then, acetonitrile was distilled off under reduced pressure from the reaction mixture, and after adding thereto 200 ml of ethyl acetate, insoluble materials formed were removed by filtration. After distilling off ethyl acetate, 300 ml of n-hexane was added to the reaction mixture and the white crystals precipitated were recovered by filtration and dried in vacuo at room temperature to provide 90.1 g (yield of 65%) of the desired compound. The compound was confirmed by NMR spectral analysis, elementary analysis, and infrared absorption spectral analysis. The melting point thereof was 53°-57° C.

SYNTHESIS EXAMPLE 5

Synthesis of Copolymer (P-1)

In a reaction vessel were placed 34.2 g (0.16 mol) of

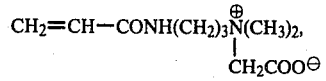

9.3 g (0.02 mol) of

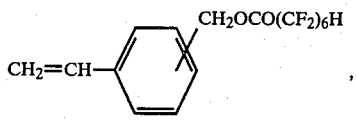

and 150 ml of methanol and the mixture was stirred while heating to 60° C. in nitrogen atmosphere. To the mixture was added dropwise a solution containing 0.2 g of α,α'-azobisisobutyronitrile (AIBN), having the formula

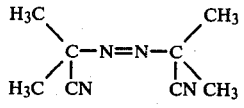

in 20 ml of methanol and the reaction was performed for 8 hours. After allowing cooling of the reaction mixture, methanol was removed to form an aqueous solution. By removing the unreacted monomers by dialysis and lyophilizing the product, a white powder was obtained. The amount of the product was 36.2 g. The product was confirmed to have the composition of Copolymer (P-1) by elementary analysis, etc.

SYNTHESIS EXAMPLE 6

Synthesis of Copolymer (P-3)

In a reaction vessel were placed 85 g (0.5 mol) of

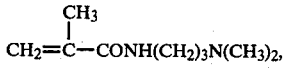

23.06 g (0.05 mol) of

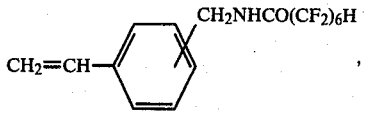

and 350 ml of methanol and the mixture was stirred while heating to 60° C. in nitrogen atmosphere. As in Synthesis Example 5, a solution of 0.5 g of AIBN in 50 ml of methanol was added dropwise to the mixture and the polymerization was performed for 8 hours. To the polymer solution formed were added 52 g (0.55 mol) of monochloroacetic acid and 106 g (0.55 mol) of a 28% methanol solution of sodium methylate, and then the mixture was heated to 60° C. for 6 hours. After cooling the reaction mixture, a part of the solution was collected, diluted with pure water, and then the $Cl^-$ content was determined with 0.1 N silver nitrate. Thus, the reactivity calculated was 100%.

Thereafter, by performing the same procedure as in Synthesis Example 5, 122 g of a white polymer was obtained. The polymer had the composition of Copolymer (P-3).

The copolymer of this invention is incorporated in at least one layer of a photographic material and the photographic layers are, for example, a surface protective layer, a backing layer, interlayers, a subbing layer, etc., in addition to silver halide photographic emulsion layers. When a backing layer is composed of two layers, the compound may be incorporated in one or both of the two layers. Furthermore, when an overcoat is formed on a surface protective layer, the compound may be incorporated in the overcoat.

In order to obtain the effect of this invention most remarkably, it is preferred to incorporate the compound of the invention in a surface protective layer, a backing layer, or an overcoat of a photographic material.

For applying the copolymer of this invention to a photographic material, the copolymer of this invention is dissolved in water or an organic solvent such as methanol, isopropanol, acetone, etc., or a mixture thereof, the resulting solution is added to a coating composition for the surface protective layer, a backing layer, an overcoat, etc., and the coating composition is coated by a dip coating method, air knife coating method, or an extrusion coating method using the hopper described in U.S. Pat. No. 2,681,294, or two or more such coating compositions are simultaneously coated by a method as described in U.S. Pat. Nos. 3,508,947, 2,941,898, 3,526,528, etc. Alternatively, the photographic material may be immersed in a solution containing the antistatic agent (or the copolymer) of this invention. Still further, a solution containing the antistatic agent (or the copolymer) of this invention may be coated on the surface of a protective layer.

It is preferred that the amount of the copolymer of this invention be from 0.01 to 20 g, and more preferably from 0.02 to 5.0 g per square meter of a photographic material. The optimum amount of the copolymer will differ according to the kind of the photographic film base employed, the photographic compositions, the form of the photographic films, and the coating system for making the photographic films.

As the supports used for the photographic materials of this invention, there are, for example, cellulose nitrate films, cellulose acetate films, cellulose acetate butyrate films, polystyrene films, polyethylene terephthalate films, polycarbonate films, laminates of these films, etc. Furthermore, there are baryta-coated papers and papers coated or laminated with a polymer of an α-olefin having, in particular, from 2 to 10 carbon atoms, such as polyethylene, polypropylene, ethylene-butene copolymer.

In the photographic materials of this invention, each photographic layer may contain various binders, for example, hydrophilic colloids including: proteins such as gelatin, colloidal albumin, casein, etc.; cellulose compounds such as carboxymethyl cellulose, hydroxyethyl cellulose, etc.; sugar derivatives such as agar agar, sodium alginate, starch derivatives, etc.; synthetic hydrophilic polymers such as polyvinyl alcohol, poly-N-vinylpyrrolidone; polyacrylic acid copolymers, polyacrylamide, and the derivatives or partially decomposed products of them. If desired, these colloids may be used as a mixture of two or more.

Among the above-described hydrophilic colloids, gelatin is most generally used, and the term "gelatin" used in this specification includes so-called lime-treated gelatin, acid-treated gelatin, and enzyme-treated gelatin. Gelatin may be partially or wholly replaced with a synthetic polymer or may be replaced with a gelatin derivative obtained by modifying gelatin with a reagent having one radical capable of reacting with the amino group, imino group, hydroxy group or carboxy group contained in the gelatin molecule as a functional group or with a graft polymer obtained by bonding the molecular chain of a polymer to gelatin.

A silver halide emulsion used for the photographic material of this invention is usually prepared by mixing an aqueous solution of a water-soluble silver salt (e.g., silver nitrate) and an aqueous solution of a water-soluble halide (e.g., potassium bromide) in the presence of an aqueous solution of a water-soluble polymer such as gelatin. Examples of the silver halide used in this invention are silver chloride and silver bromide as well as mixed silver halides such as silver chlorobromide, silver iodobromide, silver chloroiodobromide, etc.

The silver halide photographic emulsions used in this invention can be subjected to a spectral sensitization or supersensitization using polymethine sensitizing dyes such as cyanine, merocyanine, carbocyanine, etc., solely or a combination thereof or as a combination with styryl dyes.

Also, the silver halide photographic emulsions for the photographic materials of this invention may further contain various additives for preventing the reduction in sensitivity and the formation of fog during the production, preservation, or processing of photographic materials. As such additives, there are not only 4-hydroxy-6-methyl-1,3,3a,7-tetraazaindene, 3-methylbenzothiazole, 1-phenyl-5-mercaptotetrazole, etc., but also many known compounds such as heterocyclic compounds, mercury-containing compounds, mercapto compounds, metal salts, etc.

In the case of using silver halide photographic emulsions for color photographic materials, couplers may be incorporated in the silver halide emulsion layers. Examples of the couplers useful in this invention include known couplers such as 4-equivalent type diketomethylene yellow couplers, 2-equivalent type diketomethylene yellow couplers, 4-equivalent type pyrazolone magenta couplers, 2-equivalent type pyrazolone magenta couplers, indazolone magenta couplers, α-naphthol cyan couplers, and phenolic cyan couplers.

The silver halide emulsion layers and other photographic layers of the photographic materials of this invention can be hardened by various kinds of organic or inorganic hardening agents (solely or as combinations of them). Typical examples of the hardening agents are aldehyde series compounds such as mucochloric acid, formaldehyde, trimethylolmelamine, glyoxal, 2,3-dihydroxy-1,4-dioxane, 2,3-dihydroxy-1,4-dioxane, 2,3-dihydroxy-5-methyl-1,4-dioxane, succinaldehyde, glutaraldehyde, etc.; active vinyl compounds such as divinylsulfone, methylenebismaleimide, 1,3,5-triacryloylhexahydro-s-triazine, 1,3,5-trivinylsulfonylhexahydro-s-triazine bis(vinylsulfonylmethyl) ether, 1,3-bis(vinylsulfonylmethyl)propanol-2, bis(α-vinylsulfonylacetamido)ethane, etc.; active halides such as 2,4-dichloro-6-hydroxy-s-triazine.sodium salt, 2,4-dichloro-6-methoxy-s-triazine, etc.; and ethyleneimine compounds such as 2,4,6-triethyleneimino-s-triazine, etc.

In the photographic layers of the photographic materials of this invention, surface active agents may be incorporated solely or as a combination thereof. They are used as a coating aid but they are sometimes used for other purposes, e.g., for emulsification, for the improvement of photographic properties such as sensitivity, etc., and for controlling static property, etc.

As such surface active agents, there are natural surface active agents such as saponin, etc.; nonionic surface active agents such as alkylene oxide series, glycerol series, and glycidol series surface active agents; cationic surface active agents such as higher alkylamines, quaternary ammonium salts, heterocyclic compounds (e.g., pyridine, etc.), phosphonium compounds, sulfonium compounds, etc.; anionic surface active agents containing acid groups such as carboxylic acid, sulfonic acid, phosphoric acid, sulfuric acid ester, phosphoric acid, ester, etc.; and amphoteric surface active agents such as aminoacids, aminosulfonic acids, amino alcohol sulfuric acid or phosphoric acid esters, etc.

Some surface active agents useful in this invention are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, 3,666,478, and 3,507,660, British Pat. No. 1,198,450 as well as Ryohei Oda, et al., *Synthesis and Application of Surface Active Agents,* published by Maki Shoten, 1964, A. W. Perry, *Surface Active Agents,* published by Interscience Publication Incorporated, 1958, J. P. Sisley, *Encyclopedia of Surface Active Agents,* Vol. 2, published by the Chemical Publishing Company, 1964.

In this invention, fluorine series surface active agents can be used, and examples of such fluorine surface active agents are described, for example, in British Pat. Nos. 1,330,356 and 1,524,631, U.S. Pat. Nos. 3,666,478 and 3,589,906, Japanese Patent Publication No. 36687/77 and Japanese Patent Application (OPI) Nos. 46733/74 and 32322/76.

Also, in this invention the photographic layers may further contain lubricating compositions such as the modified silicones described, for example, in U.S. Pat. Nos. 3,079,837, 3,080,317, 3,545,970 and 3,294,537 and Japanese Patent Application (OPI) No. 129520/77.

The photographic layers of the photographic materials of this invention can further contain polymer latexes as described in U.S. Pat. Nos. 3,411,911 and 3,411,912 and Japanese Patent Publication No. 5331/70 and also silica, strontium sulfate, barium sulfate, polymethyl methacrylate, etc., as a matting agent.

By the practice of this invention, the problems due to static charges occurring during the production and/or use of the photographic materials can be prevented.

For example, the occurrence of static marks caused by: (1) contact between the surface of the emulsion layers and the surface of backing layer of photographic materials, (2) contact between the surface of the emulsion layer and the surface of the emulsion layer of photographic materials, and (3) contact of photographic materials with other materials which are frequently brought into contact with the photographic materials, e.g., rubber, metals, plastics, and fluorescent intensifying screens, can also be prevented.

The invention is practically explained by the following examples. It should be understood that the invention is not limited to embodiments shown in these examples.

EXAMPLE 1

Samples 1 to 8 were each prepared by coating one surface of a polyethylene terephthalate film (about 175 μm thick (dry)) with a silver halide emulsion layer and then a protective layer as described below, and then drying.

Silver halide emulsion layer (about 5 μm thick (dry))

Binder: 2.5 g/m$^2$ of gelatin
Silver coverage: 5 g/m$^2$
Silver halide composition: 1.5 mol% AgI and 98.5 mol% AgBr
Antifoggant: 1-phenyl-5-mercaptotetrazole in an amount of 0.5 g/100 g of Ag Protective layer (about 1 μm thick (dry))

Binder: 1.7 g/m$^2$ of gelatin
Coating agent: 7 mg/m$^2$ of N-oleyl-N-methyltaurine sodium salt
Hardening agent: 2,4-dichloro-6-hydroxy-1,3,5-triazine.sodium salt at 0.4 g/100 g of gelatin Sample 1 was composed of the aforesaid composition only, and Samples 2 to 6 further contained 500 mg/m$^2$ of Copolymers (P-1), (P-3), (P-5), (P-7), and (P-9) of this invention, respectively, in the protective layers.

Also, for comparison, Samples 7 and 8, each having the above-mentioned compositions and further containing 500 mg/m$^2$ of following Comparison Polymer A disclosed in Japanese Patent Application (OPI) No. 125726/75 and Comparison Polymer B disclosed in Japanese Patent Application (OPI) No. 129520/77, respectively, in each protective layer were prepared.

Comparison Polymer A:

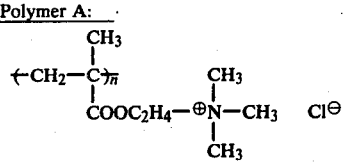

Comparison Polymer B:

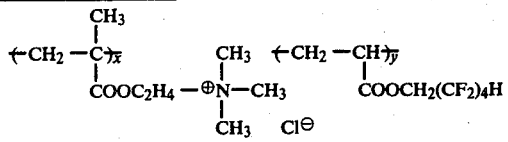

(x:y = 80:20)

The antistatic property of these samples was determined by the following method.

After humidifying the unexposed samples for 2 hours at 25° C. and 25% RH, each of the samples was rubbed by a Neoprene rubber roller on the emulsion layer side of the sample, developed in a developer having a composition as shown below, fixed, and washed, and then the extent of formation of static marks was determined.

| Developer Composition | |
|---|---|
| Warm Water | 800 ml |
| Sodium Tetrapolyphosphate | 2.0 g |
| Anhydrous Sodium Sulfite | 50 g |
| Hydroquinone | 10 g |
| Sodium Carbonate (monohydrate) | 40 g |
| 1-Phenyl-3-pyrazolidone | 0.3 g |
| Potassium Bromide | 2.0 g |
| Water to make | 1,000 ml (pH 10.2) |

Then, after exposing the unexposed samples on a tungsten lamp through Filter SP-14 made by Fuji Photo Film Co., Ltd. at an exposure amount of 1.6 CMS (candela meter second), each sample was developed in the developer having the above composition for 30 sec at 35° C., fixed, washed, and then the sensitivity and fog were measured. Furthermore, after preserving corresponding unexposed samples for 3 days at 50° C., each of the preserved samples was exposed and processed under the same conditions as above, and then the sensitivity and fog were measured. Thus, the influence of the additives on the photographic properties was determined.

The resulting antistatic and photographic properties of each sample are shown in Table 1.

TABLE 1

| Sample No. | Antistatic Agent | Antistatic* Property | Photographic Properties: Directly after Coating Fog | Directly after Coating Sensitivity | After Preservation Fog | After Preservation Sensitivity |
|---|---|---|---|---|---|---|
| 1 | None (control) | D | 0.16 | 0 | 0.17 | −0.01 |
| 2 | Copolymer (P-1) | A | 0.16 | 0 | 0.16 | 0 |
| 3 | Copolymer (P-3) | A | 0.16 | 0 | 0.16 | 0 |
| 4 | Copolymer (P-5) | A | 0.16 | 0 | 0.16 | 0 |
| 5 | Copolymer (P-7) | A | 0.16 | 0 | 0.17 | 0 |
| 6 | Copolymer (P-9) | A | 0.16 | 0 | 0.16 | 0 |
| 7 | Comparison Polymer A | B | 0.18 | +0.01 | 0.40 | +0.02 |
| 8 | Comparison Polymer B | A–B | 0.17 | 0 | 0.37 | +0.01 |

Indicates the degree of the formation of static marks.

In Table 1 the extent of the formation of static marks was evaluated visually using the following four grades:

A: No static marks formed.

B: Static marks formed a little.

C: Static marks formed considerably.

D: Static marks formed over most of surface.

The sensitivity in Table 1 was determined by taking the sensitivity of the control sample (Sample No. 1) directly after coating as a standard sensitivity with an arbitrary value 0, and the sensitivity of other samples was a deviation from the standard sensitivity shown by the absolute value of log E. No deviation from the standard sensitivity indicates that here was no influence on the photographic property.

From the results shown in Table 1, it is understood that the antistatic compounds of this invention had excellent antistatic effect, forming almost no static marks, and did not exhibit any adverse influences on the photographic properties such as fog, sensitivity, etc. On the other hand, it is clear that in the case of using the comparison polymers, the formation of fog after preserving the photographic films increased greatly, and hence the comparison polymers did exhibit influences on the photographic properties of the photographic materials.

EXAMPLE 2

Sample 9 was prepared in the same manner as Example 1 except that 500 mg/m$^2$ of the Comparison Polymer C disclosed in German Patent Application (OLS) No. 3,038,818 was incorporated in the protective layer in place of the Comparison Polymers A and B.

Then, for Samples 1 to 6 of Example 1 and Sample 9 in this example, the surface specific resistance and the static potential charge were measured by the following manners.

Comparison Polymer C:

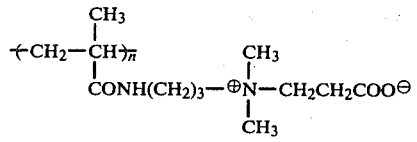

(a) Measurement of surface specific resistance:

After humidifying the sample for 2 hours at 25° C. and 25% RH (relative humidity), the sample was placed between brass electrodes (the portion of each electrode which was brought into contact with the sample was made by stainless steel) of 10 cm length at a distance between electrodes of 0.14 cm under the same conditions as above and the surface specific resistance of 1 minute value was measured by means of an electrometer, TR-8651, made by Takeda Riken K. K.

(b) Measurement of static charge generated:

Two samples (2 cm×11 cm) were laminated with each other using a two-sided adhesive tape in such manner that the protective layers were on the outside surfaces, and after humidifying the samples for 2 hours at 25° C. and 25% RH, the sample laminate was passed through two rotary white rubber rollers. Thereafter, the samples were placed in a Faraday cage and the static charge generated was measured by means of an electrometer (units in volts).

The results are shown in Table 2.

TABLE 2

| Sample No. | Antistatic Agent | Surface Specific Resistance (Ω) | Static Potential (volt) |
|---|---|---|---|
| 1 | None | $3.0 \times 10^{14}$ | +150 |
| 2 | Copolymer (P-1) | $6.2 \times 10^{12}$ | −10 |
| 3 | Copolymer (P-3) | $5.5 \times 10^{12}$ | 0 |
| 4 | Copolymer (P-5) | $7.9 \times 10^{12}$ | −5 |
| 5 | Copolymer (P-7) | $7.0 \times 10^{12}$ | +10 |
| 6 | Copolymer (P-9) | $6.8 \times 10^{12}$ | −10 |
| 9 | Comparison Polymer C | $8.7 \times 10^{12}$ | +155 |

From the results shown in Table 2, it is understood that the antistatic compounds of this invention were also effective for the reduction in surface specific resistance and static potential in addition to static prevention. On the other hand, the comparison polymer used in Sample No. 9 reduced the surface specific resistance but did not reduce the static potential.

EXAMPLE 3

After humidifying Samples 1 to 8 as in Example 1 and Sample 9 as in Example 2 for 2 days at 40° C. and 70% RH, two sheets (4 cm×4 cm) of each sample were rubbed with each other at the surfaces of the protective layers, preserved for 1 day under the conditions of 40° C., 70% RH, while applying thereon a load of 800 g, then the sample sheets were separated from each other, and the area of the stuck portion was measured, evaluated as described below.

| | | |
|---|---|---|
| Rank A: | Area of stuck portion | 0–40% |
| Rank B: | " | 41–60% |
| Rank C: | " | 61–80% |
| Rank D: | " | ≧81% |

The results are shown in Table 3.

TABLE 3

| Sample No. | Antistatic Agent | Adhesion Resistance |
|---|---|---|
| 1 | None | C |
| 2 | Copolymer (P-1) | A |
| 3 | Copolymer (P-3) | A |
| 4 | Copolymer (P-5) | A |
| 5 | Copolymer (P-7) | A |
| 6 | Copolymer (P-9) | A |
| 7 | Comparison Polymer A | D |
| 8 | Comparison Polymer B | C |
| 9 | Comparison Polymer C | C |

From the results shown in Table 3, it is clear that the samples using the compounds of this invention show less adhesion of protective layers with each other and showed good adhesion resistance as compared with the samples using the comparison compounds.

EXAMPLE 4

In 10 ml of water was dissolved 8 g of each of the Copolymers (P-3), (P-6), (P-10) and (P-12) of this invention and the Comparison Polymers A, B, and C and the solution was diluted with a mixture of 650 ml of methanol and 350 ml of acetone. The solution obtained was coated on a cellulose triacetate film at a coverage of 50 mg/m$^2$ and dried. Furthermore, a diacetyl cellulose solution using a mixture of 850 ml of acetone and 150 ml of methanol was coated on the layer.

Then, the opposite surface of the film base having the coated layers was coated with a direct X-ray silver halide photographic emulsion containing 9% by weight gelatin and 9% by weight silver halide.

Thus, Sample 10 containing no antistatic agent, and Samples 11 to 17 containing the Copolymers (P-3), (P-6), (P-10) and (P-12) of the invention and the Comparison Polymers A, B and C, respectively, were prepared. The antistatic property of these samples was determined in the same manner as in Example 1, except that the back surface of the film opposite to the emulsion layer side was rubbed by a Neoprene rubber roller. Furthermore, the adhesion resistance was determined in the same manner as in Example 3, except that the back surface was tested in place of the protective layer.

The results are shown in Table 4.

TABLE 4

| Sample No. | Antistatic Agent | Adhesion Resistance | Formation of Static Mark |
|---|---|---|---|
| 10 | None (control) | C | D |
| 11 | Copolymer (P-3) | A | A |
| 12 | Copolymer (P-6) | A | A |
| 13 | Copolymer (P-10) | A | A |
| 14 | Copolymer (P-12) | A | A |
| 15 | Comparison Polymer A | D | B |
| 16 | Comparison Polymer B | B | A–B |
| 17 | Comparison Polymer C | C | B |

From the results shown in Table 4, it is understood that the samples using the compounds of this invention scarcely formed static marks and showed very good adhesion resistance. On the other hand, it is clear that in the samples using the compairson compounds, static marks formed to a greater extent, and in the control sample containing no antistatic agent, static marks formed over the whole surface, and these samples showed poor adhesion resistance.

EXAMPLE 5

Samples 18 to 21 were prepared, each having, on a triacetyl cellulose support, in sequence, an antihalation layer, a red-sensitive silver halide emulsion layer, an interlayer, a green-sensitive silver halide emulsion layer, a yellow filter layer, a blue-sensitive silver halide emulsion layer, and a protective layer. The compositions of the layers are shown below.

Antihalation layer

Binder: 4.4 g/m$^2$ of gelatin
Hardening agent: 1,3-bis(vinylsulfonyl)propanol-2 at 1.2 g/100 g of binder
Coating aid: 4 mg/m$^2$ of sodium dodecylbenzenesulfonate
Antihalation component: 0.4 g/m$^2$ of black colloid silver

Red-sensitive silver halide emulsion layer

Binder: 7 g/m$^2$ of gelatin
Hardening agent: 1,3-bis(vinylsulfonyl)propanol-2 at 1.2 g/100 g of binder
Coating aid: 10 mg/m$^2$ of sodium dodecylbenzenesulfonate
Silver coverage: 3.1 g/m$^2$
Silver halide composition: 2 mol% AgI and 98 mol% AgBr
Antifoggant: 4-hydroxy-6-methyl-1,3,3a,7-tetraazaindene at 0.9 g/100 g of Ag
Coupler: 1-hydroxy-4-(2-acetylphenyl)azo-N-[4-(2,4-di-tert-amylphenoxy)butyl]-2-naphthamide at 38 g/100 g of Ag
Sensitizing dye: anhydro-5,5'-dichloro-9-ethyl-3,3'-di(3-sulfopropyl)thiacarbocyaninehydroxide.pyridinium salt at 0.3 g/100 g of Ag

Interlayer

Binder: 2.6 g/m$^2$ of gelatin
Hardening agent: 1,3-bis(vinylsulfonyl)propanol-2 at 1.2 g/100 g of binder
Coating aid: 12 mg/m$^2$ of sodium dodecylbenzenesulfonate

Green-sensitive silver halide emulsion layer

Binder: 6.4 g/m$^2$ of gelatin

Hardening agent: 1,3-bis(vinylsulfonyl)propanol-2 at 1.2 g/100 g of binder
Coating aid: 9 mg/m$^2$ of sodium dodecylbenzenesulfonate
Silver coverage: 2.2 g/m$^2$
Silver halide composition: 3.3 mol% AgI and 96.7 mol% AgBr
Stabilizer: 4-hydroxy-6-methyl-1,3,3a,7-tetraazaindene at 0.6 g/100 g of Ag
Coupler: 1-(2,4,6-trichlorophenyl)-3-[3-(2,4-di-tert-amylphenoxy)acetamido]-4-(4-methoxyphenyl)azo-5-pyrazolone at 37 g/100 g of Ag
Sensitizing dye: anhydro-5,5'-diphenyl-9-ethyl-3,3'-di(2-sulfoethyl)oxacarbocyanine-hydroxide.-pyridinium salt at 3 g/100 g of Ag Yellow filter layer Binder: 2.3 g/m$^2$ of gelatin
Filter component: 0.7 g/m$^2$ of yellow colloid silver
Hardening agent: 1,3-bis(vinylsulfonyl)propanol-2 at 1.2 g/100 g of binder
Surface active agent: 7 mg/m$^2$ of 2-sulfonatosuccinic acid bis(2-ethylhexyl) ester sodium salt Blue-sensitive silver halide emulsion layer Binder: 7 g/m$^2$ of gelatin
Hardening agent: 1,3-bis(vinylsulfonyl)propanol-2 at 1.2 g/100 g of binder
Coating aid: 8 mg/m$^2$ of sodium dodecylbenzenesulfonate
Silver coverage: 2.2 g/m$^2$
Silver halide composition: 3.3 mol% AgI and 96.7 mol% AgBr
Stabilizer: 4-hydroxy-6-methyl-1,3,3a,7-tetraazaindene at 0.4 g/100 g of Ag
Coupler: 2'-chloro-5'-[2-(2,4-di-tert-amylphenoxy)-butyramido]-α-(5,5'-dimethyl-2,4-dioxo-3-oxazolidinyl)-α-(4-methoxybenzoyl)acetanilide at 45 g/100 g of Ag Protective layer Binder: 2 g/m$^2$ of binder and 0.3 g/m$^2$ of a (1:1) copolymer of styrene-maleic anhydride having a mean molecular weight of about 100,000
Hardening agent: 1,3-bis(vinylsulfonyl)propanol-2 at 1.2 g/100 g of binder
Coating aid: 5 mg/m$^2$ of sodium dioctylsulfosuccinate Sample 18 had the layers of the above-described compositions only, whereas Samples 19 to 21 further contained 500 mg/m$^2$ of Copolymers (P-2) and (P-3) of this invention, and Comparison Polymer B, respectively, in each protective layer.

The antistatic property was determined in the same manner as in Example 1, except that an ordinary color development was performed instead of performing the black-and-white development in Example 1. The results are shown in Table 5.

TABLE 5

| Sample No. | Antistatic Agent | Formation of Static Mark |
|---|---|---|
| 18 | None | D |
| 19 | Copolymer (P-2) | A |
| 20 | Copolymer (P-3) | A |
| 21 | Comparison Polymer B | B |

From the results shown in Table 5, it is clear that the samples using the copolymers of this invention formed almost no static marks.

Each of the samples was also exposed based on the JIS K7613/1976 method and color developed in a conventional manner. The results were that Sample 21 using the comparison polymer formed severe fog in the green-, blue-, and red-sensitive silver halide emulsion layers, but in the case of the samples of this invention, the copolymers of this invention used had scarcely any adverse influences on the photographic properties.

EXAMPLE 6

One surface of a cellulose triacetate film support was coated with a backing layer and a protective layer for the backing layer, and the opposite surface thereof was coated with the multilayer color photographic layers as in the control sample (Sample No. 18) in Example 5. The compositions of the backing layer and the protective layer for the backing layer were as follows:

Backing layer

Binder: 6.2 g/m$^2$ of binder
Salt: 0.1 g/m$^2$ of potassium nitrate
Hardening agent: 1,3-bis(vinylsulfonyl)propanol-2 at 1.2 g/100 g of binder Protective layer for backing layer Binder: 2.2 g/m$^2$ of gelatin
Matting agent: 20 mg/m$^2$ of polymethyl methacrylate (mean grain size of 2.5 μm)
Hardening agent: 1,3-bis(vinylsulfonyl)propanol-2 at 1.2 g/100 g of binder
Coating aid: 40 mg/m$^2$ of sodium dioctylsulfosuccinate In this example, Sample 22 had layers formed from the above compositions only, but Samples 23 to 25 further included 0.8 g/m$^2$ of the Copolymers (P-3), (P-6) and (P-8), respectively, of this invention in each backing layer. The surface specific resistance of each of the backing layers of these samples was determined in the same manner as in Example 2. The results are shown in Table 6.

TABLE 6

| Sample No. | Antistatic Agent | Surface Specific Resistance (Ω) |
|---|---|---|
| 22 | None | $4.0 \times 10^{13}$ |
| 23 | Copolymer (P-3) | $1.3 \times 10^{11}$ |
| 24 | Copolymer (P-6) | $3.5 \times 10^{11}$ |
| 25 | Copolymer (P-8) | $2.6 \times 10^{11}$ |

From the results shown in Table 6, it is understood that the use of the copolymers of this invention greatly reduced the surface specific resistance and was effective for static prevention.

EXAMPLE 7

A photographic material having the same composition as Sample 1 in Example 1 was immersed in an aqueous solution of 2% by weight of the compound shown in Table 7 for 5 seconds and then spontaneously dried under the conditions of 25° C. and 65% RH. Then, after humidifying each of the samples for 2 hours at 25° C. and 25% RH, the formation of static mark was determined in the same manner as in Example 1. The results are shown in Table 7.

TABLE 7

| Sample No. | Antistatic Agent | Formation of Static Mark |
|---|---|---|
| 26 | None | D |

TABLE 7-continued

| Sample No. | Antistatic Agent | Formation of Static Mark |
|---|---|---|
| 27 | Copolymer (P-4) | A |
| 28 | Copolymer (P-10) | A |
| 29 | Copolymer (P-12) | A |

From the results shown in Table 7, it is clear that when the compounds of this invention were applied to photographic material as an aqueous solution thereof, they showed good antistatic effect.

EXAMPLE 8

A cellulose acetate film (130 μm thick (dry)) having a gelatin subbing layer thereon was coated with a solution having the following composition to form an antistatic layer.

| | |
|---|---|
| Antistatic Agent | 8 g |
| Water | 10 ml |
| Methanol | 600 ml |
| Acetone | 400 ml |

On the antistatic layer were formed, in sequence, an antihalation layer and a red-sensitive silver halide emulsion layer having the same compositions described in Example 5 by means of a co-extrusion method. The uneven coating of the silver halide emulsion layer caused by the static phenomenon during coating was observed visually using transmitted light, and the results are shown in Table 8.

TABLE 8

| Sample No. | Antistatic Agent | Uneven Coating |
|---|---|---|
| 30 | None | Significant |
| 31 | Copolymer (P-3) | Scarcely observed |
| 32 | Copolymer (P-6) | " |

From the results shown in Table 8, it becomes clear that the sample containing the antistatic agent of this invention between the subbing layer and the silver halide emulsion layer gave substantially no uneven coating when coating of the silver halide emulsion layer.

EXAMPLE 9

A polyethylene terephthalate film support (175 μm thick (dry)) was coated with an aqueous solution of 2.5% by weight copolymer composed of 48 mol% butadiene, 47 mol% styrene, and 5 mol% itaconic acid and 0.15% by weight 2,4-dichloro-6-hydroxy-1,3,5-triazine sodium salt at a coverage of 20 ml/m$^2$ and dried for 10 minutes at 120° C. In this case Sample 33 contained no antistatic agent and Samples 34 and 35 contained 1.0% by weight of Copolymers (P-2) and (P-7), respectively, of the invention. The surface specific resistance of these samples was measured by the same method as in Example 1, and the results obtained are shown in Table 9.

TABLE 9

| Sample No. | Antistatic Agent | Surface Specific Resistance (Ω) |
|---|---|---|
| 33 | None | Above $10^{15}$ |
| 34 | Copolymer (P-2) | $2.1 \times 10^{12}$ |
| 35 | Copolymer (P-7) | $5.4 \times 10^{12}$ |

From the results shown in Table 9, it is understood that the copolymers of this invention were effective for greatly reducing the surface specific resistance and static prevention in the case of subbing layer.

EXAMPLE 10

For confirming the formation of scum in the cases of processing with a developer and fix solution, about 3 m$^2$ of each of Samples 1 to 8 as described in Example 1 was processed by a simple automatic processer, Fuji X-ray Processor RN (trademark of Fuji Photo Film Co., Ltd.) using a developer Fuji RD-III (trademark of Fuji Photo Film Co., Ltd.) and a fix solution Fuji F (trademark of Fuji Photo Film Co., Ltd.) of 12 liters each, and then the formation of scum in the developer and the fix solution was observed visually.

The developer and the fix solution used were the developer and the fix solution for processing medical X-ray film made by Fuji Photo Film Co., Ltd. The results of the scum test are shown in Table 10.

TABLE 10

| Sample No. | Formation of Scum in Fix Solution | Formation of Scum in Developer |
|---|---|---|
| 1 | None | None |
| 2 | " | " |
| 3 | " | " |
| 4 | " | " |
| 5 | " | " |
| 6 | " | " |
| 7 | Small amount | Large amount |
| 8 | " | " |

From the results shown in Table 10, it is clear that the samples using the compounds of this invention formed less scum as compared with the samples using the comparison cation polymers.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support and at least one layer of the photographic material containing a copolymer including, as copolymerizable components, a betaine-containing polymerizable monomer represented by formula (I) or (II) and a fluorine-containing polymerizable monomer represented by formula (III)

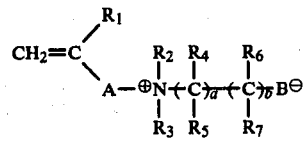

(I)

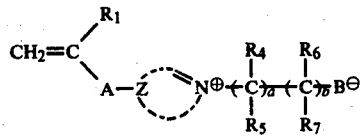

(II)

-continued (III)

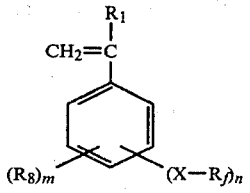

wherein $R_1$ represents hydrogen, a halogen atom, an alkyl group, or a substituted alkyl group;

$R_2$, $R_3$, $R_4$, $R_5$, $R_6$, and $R_7$ each represents hydrogen, an alkyl group, or a substituted alkyl group;

$R_8$ represents a hydroxy group, a nitro group, a halogen atom, a substituted or unsubstituted alkyl group having 1 to 6 carbon atoms or a substituted or unsubstituted acyl group having from 1 to 6 carbon atoms, or when $m > 1$ said $R_8$s may combine with each other to form a ring;

A represents a chemical bond, a substituted or unsubstituted alkylene group having from 1 to 8 carbon atoms, a substituted or unsubstituted aralkylene group having from 6 to 11 carbon atoms, —COO—$R_{10}$—, —O—CO—$R_{10}$—, $$-CO-\underset{\underset{R_{11}}{|}}{N}-R_{10}-$$

wherein $R_{10}$ represents a chemical bond, an alkylene group having from 1 to 8 carbon atoms, an aralkylene group having from 6 to 11 carbon atoms or an arylene group; and $R_{11}$ represents a hydrogen atom, an alkyl group having from 1 to 8 carbon atoms which may be substituted, or an atomic group necessary for forming together with $R_2$, $R_3$ or $R_6$ a heterocyclic ring, X represents $-(R_{12})_x-Y-(R_{13})_y-W$ where Y and W represents —O—, —COO—, —OCO—, $$-\overset{\overset{R_{11}}{|}}{C}O\overset{\overset{R_{11}}{|}}{N}-,$$

—NCO—, —S—, —SCO—, $$-SO_2\overset{\overset{R_{11}}{|}}{N}-,\ -\overset{\overset{R_{11}}{|}}{N}-SO_2-,\ -\underset{\underset{O}{\|}}{C}-,\ \text{or}\ -\underset{\underset{R_{11}}{|}}{N}-$$

in which $R_{11}$ has the same meaning as defined above, $R_{12}$ and $R_{13}$ represent a chemical bond, an alkylene group having from 1 to 8 carbon atoms; an aralkylene group having from 6 to 11 carbon atoms, or an arylene group; and x and y are 0 or 1; and Z represents a 5-membered or 6-membered ring including a quaternary nitrogen atom which may contain an oxygen atom or a non-quaternary nitrogen atom.

2. A photographic material as in claim 1, wherein said copolymer is incorporated in a surface protective layer of the photographic material.

3. A photographic material as in claim 1, wherein said copolymer is incorporated in a backing layer of the photographic material.

4. A photographic material as in claim 1, wherein said copolymer is incorporated in an overcoat formed on a surface protective layer of the photographic material.

5. A photographic material as in claim 1, 2, 3, or 4, wherein the amount of the copolymer is from 0.01 to 20 g per square meter of the photographic material.

6. A photographic material as in claim 1, 2, 3, or 4, wherein the coverage of the copolymer is from 0.02 to 5.0 g/m$^2$ of the photographic material.

7. A photographic material as in claim 1, 2, 3, or 4, wherein the betaine monomer and the fluorine-containing monomer represent at least 50 mol% of the total content of the copolymer.

8. A photographic material as in claim 7, wherein the betaine monomer represents from 95 to 50 mol% of the total content of the copolymer, the fluorine-containing monomer represents from 50 to 5 mol% of the total content of the copolymer, and other monomer components represent from 45 to 0 mol% of the total content of the copolymer.

9. A photographic material as in claim 5, wherein the betaine monomer and the fluorine-containing monomer represent at least 50 mol% of the total content of the copolymer.

10. A photographic material as in claim 9, wherein the betaine monomer represents from 95 to 50 mol% of the total content of the copolymer, the fluorine-containing monomer represents from 50 to 5 mol% of the total content of the copolymer and other monomer components represent from 45 to 0 mol% of the total content of the copolymer.

11. A photographic material as in claim 1, 2, 3, or 4, wherein $R_8$ represents a hydroxy group, a nitro group, a halogen atom, or an alkyl group having from 1 to 6 carbon atoms.

12. A photographic material as in claim 11, wherein $R_8$ is an alkyl group substituted with a halogen atom or a hydroxy group.

13. A photographic material as in claim 1, 2, 3, or 4, wherein X represents —$R_{12}$—O—$R_{13}$—, $$-R_{12}-\overset{\overset{R_{11}}{|}}{N}-CO-R_{13}-,$$

—$R_{12}$—COO—$R_{13}$—, $R_{12}$—OCO—$R_{13}$—, $$-R_{12}-SO_2-\overset{\overset{R_{11}}{|}}{N}-R_{13}-,\ \text{or}\ -COO-R_{13}-\overset{\overset{R_{11}}{|}}{N}-SO_2-.$$

14. A photographic material as in claim 1, 2, 3, or 4, wherein the copolymer includes a component of formula (II) wherein Z is substituted by an alkyl group, a substituted alkyl group, a nitro group, or a hydroxy group.

15. A photographic material as in claim 14, wherein Z is a pyridine ring, an imidazole ring or a benzimidazole ring.

* * * * *